US005335852A

United States Patent [19]

Muntean et al.

[11] Patent Number: 5,335,852

[45] Date of Patent: Aug. 9, 1994

[54] LUBRICATION OIL CONTROLLED UNIT INJECTOR

[75] Inventors: George L. Muntean; Harry L. Wilson; Gary L. Gant, all of Columbus, Ind.

[73] Assignee: Cummins Engine Company, Inc., Columbus, Ind.

[21] Appl. No.: 10,313

[22] Filed: Jan. 28, 1993

[51] Int. Cl.[5] ..... F02M 47/02

[52] U.S. Cl. ..... 239/89; 239/90; 239/95; 123/446; 123/501

[58] Field of Search ..... 239/88-92, 239/96; 123/446, 500-502

[56] References Cited

U.S. PATENT DOCUMENTS

| | | | |
|---|---|---|---|
| 4,249,499 | 2/1981 | Perr . | |
| 4,281,792 | 8/1981 | Sisson et al. . | |
| 4,410,138 | 10/1983 | Peters et al. . | |
| 4,531,672 | 7/1985 | Smith . | |
| 5,072,709 | 12/1991 | Long et al. | 239/89 |
| 5,143,291 | 9/1992 | Grinsteiner | 239/88 |

FOREIGN PATENT DOCUMENTS

| | | | |
|---|---|---|---|
| 3914876 | 11/1989 | Fed. Rep. of Germany | 123/501 |

*Primary Examiner*—Karen B. Merritt

*Attorney, Agent, or Firm*—Sixbey, Friedman, Leedom & Ferguson

[57] ABSTRACT

A unit fuel injector adapted for periodic injection of fuel into a combustion chamber of an engine at variable times from cycle to cycle under the control of the engine lubrication fluid is provided, comprising an injector body containing an injector cavity and a discharge orifice communicating with one end of the injector cavity to discharge fuel into the combustion chamber, a lubrication fluid timing circuit and a fuel metering circuit separate from the lubrication fluid timing circuit. A lubrication fluid link positioned in the lubrication fluid timing circuit within the injector cavity has a variable effective length which is varied by the operation of a control valve positioned within the lubrication timing circuit to vary the timing of injection. The control valve is operated to control the flow of lubrication fluid in the lubrication fluid timing circuit to control both the timing of injection and the metering of fuel on a cycle by cycle basis. The control valve is operable to be placed in a first position in which lubrication fluid may flow through the lubrication fluid timing circuit into the timing chamber and fuel flow from the fuel metering circuit into the metering chamber is shut off and a second position in which lubrication fluid flow into the timing chamber is shut off. Lubrication fluid is maintained at a higher pressure than the fuel pressure when the control valve is in the first position to stop the movement of a metering plunger to define the metered quantity of fuel thereby avoiding the need for a bias spring. By using lubrication fluid as timing fluid in a timing circuit separate from the fuel metering circuit, the amount of fuel required by the injector and the amount of heated fuel returned to the fuel supply tank is minimized.

31 Claims, 3 Drawing Sheets

LUBRICATION OIL CONTROLLED UNIT INJECTOR

TECHNICAL FIELD

This invention relates generally to an improved unit fuel injector using lubrication oil for providing accurate and reliable control and variation of the timing and metering of injection and particularly to a unit fuel injector capable of effectively meeting the fuel injection pressure and temperature requirements associated with recent and future emission standards.

BACKGROUND OF THE INVENTION

Unit fuel injectors operated by cams, have long been used in compression ignition internal combustion engines for their accuracy and reliability. The unit injector typically includes an injector body having a nozzle at one end and a cam driven injector plunger mounted for reciprocating movement within the injector body. In the typical unit fuel injector, a mechanical link, which is cam actuated, physically communicates with a lower, intermediate or upper plunger which moves inwardly, during the injection event, to force fuel out of an injector orifice(s) into the combustion chamber. Prior to each injection event, fuel is metered into an injection chamber with the amount of fuel injected being controlled on a cycle by cycle basis.

Internal combustion engines are subjected to a variety of external as well as internal variable conditions ultimately affecting the performance of the engine. Examples of such conditions are engine load, ambient air pressure and temperature, timing, power output and type and amount of fuel being consumed. To achieve optimal engine operation fuel must be injected at a very high pressure to cause the maximum possible atomization of the injected fuel. In addition, the interval of injection needs to be carefully timed during each cycle of injector operation with respect to the movement of the corresponding engine piston.

Attempts have been made to provide independent control over the quantity and timing of injection during each cycle using a collapsible hydraulic link to selectively change the effective length of the cam operated fuel injector plunger assembly. For example, in U.S. Pat. No. 4,281,792 to Sisson et at., a unit fuel injector is disclosed including a two part plunger having a variable volume hydraulic timing chamber separating the plunger sections and a single solenoid valve which commences the injection on the downstroke of the plunger by closing to form a hydraulic link between the plunger sections. On the upstroke, the solenoid valve opens at a selected point to control the quantity of fuel metered below the lower plunger for injection on the subsequent downstroke. Similarly, U.S. Pat. No. 4,531,672 to Smith discloses a unit fuel injector containing a fluid timing circuit and a fluid metering circuit for providing fuel flow to respective timing and metering chambers by means of a single solenoid valve which is adapted to control separately timing and metering through variation in the time of opening and closing, respectively, during each cycle of operation. While these types of injector designs provide adequate control over both timing and metering, both designs use common metering and timing passages thereby requiring engine fuel to be used as the timing fluid. As a result, a greater amount of fuel is supplied to the unit injector than is necessary to supply the injection chamber since fuel is continually cycled through the timing chamber during injector operation. This results in a substantial amount of timing fuel being heated within the injector and subsequently drained or spilled to the fuel supply tank. The hot fuel returned to the supply tank causes undesired fuel evaporation and often requires the installation of fuel cooling heat exchangers to reduce the temperature of the fuel in the supply tank. In addition, since these fuel injector designs use a common fuel supply rail for all the injectors of an engine, a sharp pressure increase or spike is generated in the fuel supply rail each time the timing fuel spills from the high pressure timing chamber of each injector. Consequently, the pressure spike from one injector can adversely affect the reliability and control of injection metering and/or timing in other injectors.

The problems associated with draining excessive quantities of hot fuel to the supply tank and the accompanying pressure spikes have become even more apparent due to recent and upcoming legislation placing strict emission standards on engine manufacturers resulting from a concern to improve fuel economy and reduce emissions. In order for new engines to meet these standards, it is necessary to produce fuel injectors and systems capable of achieving higher injection pressures, shorter injection durations and more accurate control of injection timing. High injection pressures may be achieved in a number of ways such as by varying the cam profile, plunger diameter and/or number and size of injection orifices. Various techniques have been developed to control timing including mechanical, e.g. racks for rotating injector plungers having helical control surfaces; electronic, e.g. valves for controlling the start and/or end of injection and hydraulic, e.g. variable length hydraulic links. With respect to the latter, timing is advanced by introducing more timing fluid into the timing chamber which effectively lengthens the fluid link between the injector plungers. In the typical injector, as a result of this lengthened link, the pumping plunger commences injection and/or reaches its bottom most position at an earlier point in the rotation of the corresponding cam. Accordingly, fuel injection can occur at a point in the combustion cycle when the piston of the engine is still moving upward.

Because fuel is normally used as the timing fluid in injectors of this type, the amount of fuel which is supplied to and drained away from the injector of an engine necessarily increases as compared with injectors employing non-hydraulic timing control or no timing control. The amount of heat absorbed by the fuel and ultimately the temperature of the fuel in the fuel supply tank has been found to increase to an unacceptably high level.

Another problem encountered in fuel injectors of the type disclosed in '792 Sisson et al. and '672 Smith is overpressurization of the injector body during the timing phase of the cycle. As the upper plunger is driven into the timing chamber, timing fuel is forced out of the timing chamber back through the solenoid valve via timing passages into the common supply passages in the injector body. This flow of timing fuel into the supply passages in the injector causes excessive fuel pressure around the solenoid valve and in the injector body. As a result, a relief valve must be incorporated into the spacer portion of the injector to relieve fuel to drain thereby preventing excessive pressure build up in the injector body and possible extrusion of the O-ring seal around the solenoid valve. Moreover, the pressure increase due to pre-injection timing spill back to the fuel supply rail can have deleterious effects on the operation of other injectors. To avoid this problem in current injector designs, the fuel inlet, such as inlet 48 of the '672 Smith injector, formed in the retainer (86 of the '672 Smith injector) is reduced in size to form a starvation orifice and thereby dampen out pressure spikes that would otherwise pass into the supply rail. While useful for their intended purposes, such restricted starvation orifices require the supply rail pressure to be higher in order to provide sufficient fuel metering capability.

Other fuel injector designs which provide for variable timing and metering are disclosed in U.S. Pat. Nos. 4,249,499 to Perr and 4,410,138 to Peters et al. The unit injector design disclosed in the '499 Perr patent includes a timing mechanism having movable pistons connected between a cam drive and an injector plunger that allow timing fluid to enter a timing chamber to form a variable length hydraulic link between the pistons depending on the pressure of the supply wherein the length of the link determines the point at which injection is initiated. The timing fluid circuit, which preferably uses engine lubricant, is separate from the fuel supply or metering circuit. Therefore, since lube oil is used as a timing fluid in a separate timing circuit, neither of the above-mentioned hot fuel drain and pressure spike problems are encountered in this design. However, this design requires a separate control device for both injector timing, in the form of a variable pressure timing fluid mechanism, and for fuel metering in the form of pressure-time metering. Consequently, both timing fluid pressure and metering fuel pressure are critical variables which must be carefully controlled for proper timing and metering.

U.S. Pat. No. 4,410,138 to Peters et al. discloses a fuel injector having infinitely variable timing using a two part injector plunger which forms a variable link timing chamber between the upper and lower plungers for receiving timing fluid. Here again, although the timing fluid circuit is completely separate from the fuel metering circuit, precise control of both the timing fluid pressure and metering fuel pressure are necessary for accurate and reliable control of timing and metering.

Another important concern accentuated by higher injection pressures is the need to adequately cool unit injectors during operation. In the fuel injector designs disclosed in U.S. Pat. Nos. 4,281,791 to Sisson et al. and 4,531,672 to Smith, both the metering fuel and the timing fuel inherently function to cool the unit injector. However, it has been discovered that when fuel is used as the timing fluid, excessive heat may be absorbed by the fuel resulting in the fuel assuming an unacceptably high temperature over extended periods of engine operation. Thus, in order to ensure adequate cooling of the injector, the fuel in the fuel supply tank must be cooled using expensive coolers.

As shown in U.S. Pat. No. 5,072,709 to Long et al., some fuel injectors require one or more biasing springs positioned in the timing chamber to bring the metering plunger to a full and precise stop during the metering phase. Since fuel is used as timing fluid fuel pressure is the same on both sides of the metering plunger. The bias spring creates enough bias pressure to overcome the inertial effects of the motion of the metering plunger to stop the plunger movement during metering. However, the bias spring also creates a fixed preload which must be overcome by fuel pressure above the preload setting in order to move the plunger. This requirement of overcoming the preload of the bias spring is an undesirable feature of the design which becomes particularly emphasized at start up or cranking as the fuel or fluid pressure must be increased to a point above the spring bias preload before adequate fuel metering can commence.

An important requirement of unit fuel injectors using engine fuel as timing fluid is to provide a leak off passage between the uppermost plunger and the rocker arm or driving assembly. Without such a leak off passage, fuel leakage by the uppermost plunger would cause the fuel to be mixed with the engine lubrication oil supplied to the rocker arm and linkage assembly impairing the lubrication qualities of the lube oil and ultimately increasing engine wear.

Consequently, there is a need for a fuel injector which is capable of meeting high injection pressure requirements while adequately cooling the injector internals and which uses a simple and effective timing fluid circuit design to accurately and reliably control both timing and metering of fuel injection without causing excessive heating of the engine fuel.

SUMMARY OF THE INVENTION

It is an object of the present invention, therefore, to overcome the disadvantages of the prior art and to provide a unit fuel injector capable of accurately and reliably controlling the timing and metering of fuel injection.

It is another object of the present invention to provide a unit fuel injector using lubrication oil as timing fluid to effectively cool the fuel injector without causing excessive heating of the engine's fuel.

It is yet another object of the present invention to provide a unit fuel injector which minimizes both the mount of fuel required by the unit injector and the amount of heated fuel returned to the fuel supply tank from the unit injector.

It is a further object of the present invention to provide a unit fuel injector which requires only one control device for controlling both the timing and metering of the injector while minimizing the quantity of heated fuel returned to the fuel supply tank.

It is a still further object of the present invention to provide a unit fuel injector having separate timing fluid and metering circuits wherein control of the flow of timing fluid in the timing circuit controls the quantity of fuel metered.

Still another object of the subject invention is to eliminate the need for starvation orifices and pressure relief valves which have heretofore been required to prevent the deleterious effects on the operation of other injectors due to pressure increases in the supply rail caused by pre-injection timing fluid spill.

Yet another object of the present invention is to provide a unit fuel injector which minimizes the fuel supply pressure required at start up to achieve successful start up of the engine with minimal cranking.

These and other objects are achieved by providing a unit fuel injector adapted for periodic injection of metered quantities of fuel into a combustion chamber of an engine at variable times from cycle to cycle by means of a single solenoid controlled valve adapted to control the engine lubrication fluid, comprising an injector body containing an injector cavity and a discharge orifice communicating with one end of the injector cavity to discharge fuel into the combustion chamber and a timing plunger and a metering plunger reciprocally mounted in the injector cavity to form a timing chamber between the plungers and to form a metering chamber between the metering plunger and the discharge orifice and further comprising a lubrication fluid timing circuit and a fuel metering circuit separate from the lubrication fluid timing circuit. A lubrication fluid link of variable effective length is formed in the timing chamber in communication with the lubrication fluid timing circuit within the injector. The effective length is varied by the operation of a control valve positioned within the lubrication timing circuit to vary the timing of injection. The control valve is operated to control the flow of lubrication fluid in the lubrication fluid timing circuit to control both the timing of injection and the metering of fuel on a cycle by cycle basis. At the end of each injection event, the metering and timing plungers are at their innermost position after which the corresponding injector cam allows its timing plunger to commence outward movement and the control valve is closed to prevent lubrication fluid from flowing into the timing chamber but fuel is allowed to flow from the fuel metering circuit into the metering chamber. This condition continues until the control valve is opened to cause lubrication fluid flow into the timing chamber thereby to arrest further outward movement of the metering plunger. Lubrication fluid is maintained at a higher pressure than the fuel pressure so that when the control valve is opened, the higher pressure above the metering plunger causes the metering plunger to stop and thereby define the metered quantity of fuel. As the upper (timing) plunger continues outwardly, lubrication oil continues to flow into the expanding timing chamber. As the timing plunger reaches its outermost position and starts inwardly, the control valve remains open to allow lubrication oil to flow in reverse direction out of the timing chamber back through the control valve into the supply of lubrication oil. Depending on engine operating conditions, the control valve is caused to close at a selected point during the downstroke of the timing plunger to thereby fix the length of the timing chamber and commence injection. When the metering plunger reaches its innermost position, a timing spill path is opened to allow lubrication oil to be spilled through a restricted passage to create a hold down force sufficient to keep the metering plunger from bouncing back thereby insuring a sharp end of injection. Because the lubrication oil is used in the timing circuit, the timing plunger receives better lubrication and no leak groove is required at the upper end of the injector body because the lubrication oil that escapes from the upper end of the injector body is simply released into the rocker housing of the engine where engine lubrication oil already exists. No bias spring is required in the present design to insure that the outward movement of the metering plunger is arrested when desired because the lubrication oil supply pressure may be regulated to be, at all times, a predetermined amount above the fuel rail supply pressure. Also, the control valve controls the flow of lubrication fluid in the lubrication fluid timing circuit to cause the lubrication fluid to flow in heat exchange relationship with the injector so as to cool the injector.

DESCRIPTION OF THE PREFERRED EMBODIMENT

Throughout the application, the words "inward", "inwardly", "inner", "outward", "outwardly" and "outer" will correspond to the directions, respectively, toward and away from the point at which fuel from an injector is actually injected into the combustion chamber of the engine. The words "upper" and "lower" will refer to the portions of injector assembly which are, respectively, farthest away and closest to the engine cylinder when the injector is operatively mounted on the engine.

Figure 1:
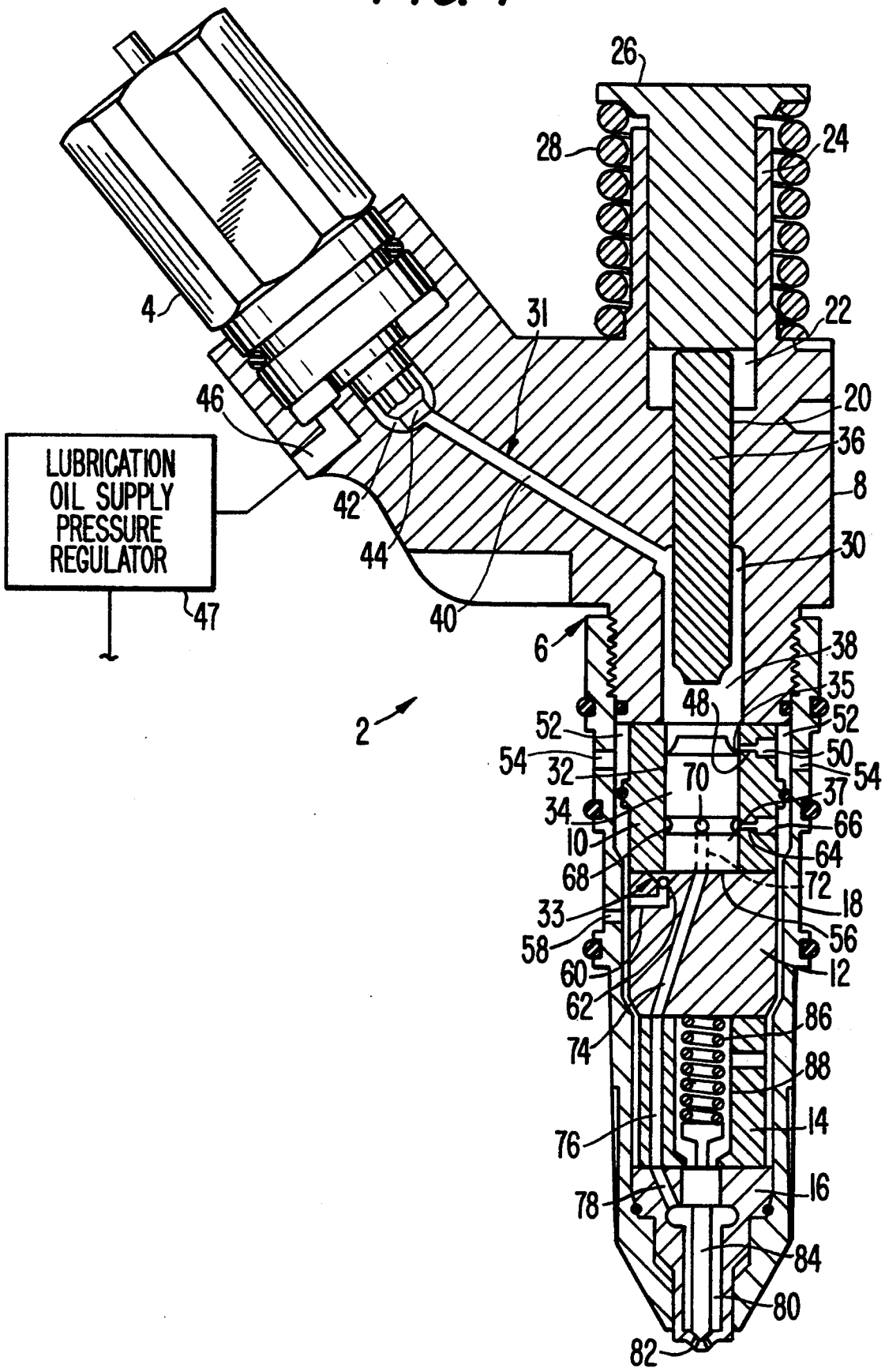
FIG. 1 is a cross-sectional view of the unit injector of the present invention as the injector would appear at the end of an injection phase.

Referring to FIG. 1, fuel injector assembly 2 includes a control valve 4 connected to an injector body 6 formed from an outer barrel 8, an inner barrel 10, a spacer 12, a spring housing 14, a nozzle housing 16 and a retainer 18. The inner barrel 10, spacer 12, spring housing 14 and nozzle housing 16 are held in a compressive abutting relationship in the interior of retainer 18 by outer barrel 8. The outer end of retainer 18 contains internal threads for engaging corresponding external threads on the lower end of outer barrel 8 to permit the entire unit injector body 6 to be held together by simple relative rotation of retainer 18 with respect to outer barrel 8.

Outer barrel 8 includes a plunger cavity 20 which opens into a larger upper cavity 22 formed in an upper extension 24 of outer barrel 8. A coupling 26 is slidably mounted in upper cavity 22 for providing a reciprocable link between the injector and a driving cam (not shown) of the engine. A coupling spring 28 is positioned around extension 24 to provide an upward bias against coupling 26 to force coupling 26 against the injector drive train and corresponding cam (not illustrated). The drive train may include a link and rocker assembly for connection to the cam.

Outer barrel 8 also includes a lower cavity 30 extending inwardly from plunger cavity 20. Inner barrel 10 includes a cavity 32 communicating with and aligned with lower cavity 30 for receiving a metering plunger 34. A timing plunger 36 is reciprocally mounted in upper cavity 22, plunger cavity 20 and lower cavity 30 of outer barrel 8. The outermost end of timing plunger 36 contacts the innermost end of coupling 26 to cause timing plunger 36 to move in response to cam rotation. The innermost end of timing plunger 36 together with the outermost end of metering plunger 34 forms a timing chamber 38 for receiving lubrication timing fluid from control valve 4.

A lubrication fluid timing circuit, indicated generally at 31, is formed in the injector assembly 2 to provide both a delivery and spill path for the lubrication timing fluid during each cycle of the injector. The lubrication fluid timing circuit includes both timing chamber 38 and various supply and spill passages which will now be described in greater detail. Lubrication timing fluid is provided to timing chamber 38 by a passage 40 which opens to a control chamber 42 for receiving a valve element 44 of control valve 4. The control valve 4 is preferably a solenoid valve assembly controlled by a solenoid of the type illustrated in commonly assigned U.S. Pat. No. (4,905,960 to Barnhart). A lubrication fluid supply passage 46 supplies lubrication fluid from a lubrication oil supply pressure regulator 47 to control chamber 42 for passage to timing chamber 38 via passage 40 depending on the position of valve element 44 as discussed hereinafter. Lubrication oil supply pressure regulator 47 maintains, at all times, the lubrication fluid upstream of control valve element 42 at a fluid pressure greater than the fuel supply rail pressure.

Inner barrel 10 includes a timing spill orifice 48 and a timing spill port 50 extending radially from cavity 32. Timing spill orifice 48 and spill port 50 provide communication between timing chamber 38 and an annular timing fluid spill channel 52 formed between inner barrel 10 and retainer 18. Timing fluid drain ports 54 are provided in retainer 18 adjacent annular channel 52 to allow lubrication fluid to flow from annular timing fluid spill channel 52 to the lubrication drain system which is fluidly connected with that portion of the injector receiving cavity (not illustrated) formed in the cylinder head of the engine adjacent timing fluid drain ports 54.

A fuel metering circuit, indicated generally at 33, is formed in injector assembly 2 to provide both a delivery and spill path for the metering fuel during each cycle of the engine. The fuel metering circuit includes a metering chamber 56 and various supply and spill passages which will now be described in greater detail. As shown in FIGS. 1 and **2*b*, metering chamber 56 is formed between the innermost end of metering plunger 34 and spacer 12. Metering chamber 56 receives fuel from a fuel supply port 58 formed in retainer 18 and a fuel inlet passage 60 formed in spacer 12. A ball check valve 62 positioned in fuel inlet passage 60 permits passage of fuel from fuel supply port 58 to metering chamber 56 while preventing fuel flow from metering chamber 56 through fuel inlet passage 60. Inner barrel 10 also includes a metering spill orifice 64 and a metering spill port 66 extending radially from cavity 32 and positioned inwardly from spill orifice 48 and spill port 50. Metering plunger 34 includes an annular groove 68, a radial passage 70 and an axial passage 72 in communication with each other to permit fuel to flow from the metering chamber 56 to metering spill orifice 64 and spill port 66 depending on the position of metering plunger 34**.

As can be appreciated from the above discussion and as shown in FIGS. 1 and **2*a*–2*e*, lubrication fluid timing circuit 31 is completely fluidically separate from fuel metering circuit 33. However, flow through each circuit is commonly controlled by the opening and closing of control valve element 44 which, in turn, causes the movement of metering plunger 34. Flow through the lubrication fluid timing and fuel metering circuits is also partially accomplished by forming a first raised portion 35 on the upper portion of metering plunger 34 adjacent timing chamber 38 and a second raised portion 37 on the lower portion of metering plunger 34 adjacent metering chamber 56 and separated from first raised portion 35 by annular groove 68. As metering plunger 34 moves in cavity 32 during each cycle, first raised portion 35 is moved between a blocking position coveting spill orifice 48 and preventing the flow of timing fluid out of timing chamber 38 through spill port 50, and a spill position uncovering spill orifice 48 allowing the flow of timing fluid from timing chamber 38 through spill port 50. Similarly, second raised portion is movable between a blocking position coveting metering spill orifice 64 and a spill position uncovering orifice 64 to allow fuel to drain from metering chamber 56 through spill port 66 via axial passage 72, radial passage 70 and annular groove 68. Fuel spilling from spill port 66** is directed back to the fuel supply system by a drain passage (not shown).

Spacer 12 also includes a fuel transfer passage 74 fluidically communicating metering chamber 56 with a fuel passage 76 formed in spring housing 14. Nozzle housing 16 includes a fuel passage 78 for directing fuel from passage 76 to a nozzle cavity 80 formed in nozzle housing 16. As illustrated in FIG. 1, nozzle housing 16 also includes injector orifices 82 which are normally closed by an axially slidable pressure actuated tip valve element 84 mounted in nozzle cavity 80. A spring 86 positioned in a central bore 88 formed in spring housing 14 biases the tip valve element 84 into the closed position blocking injector orifices 82. When the pressure of fuel within nozzle cavity 80 exceeds a predetermined level, tip valve element 84 moves outwardly to allow fuel to pass through the injector orifices 82 into the combustion chamber (not shown).

Figure 3:
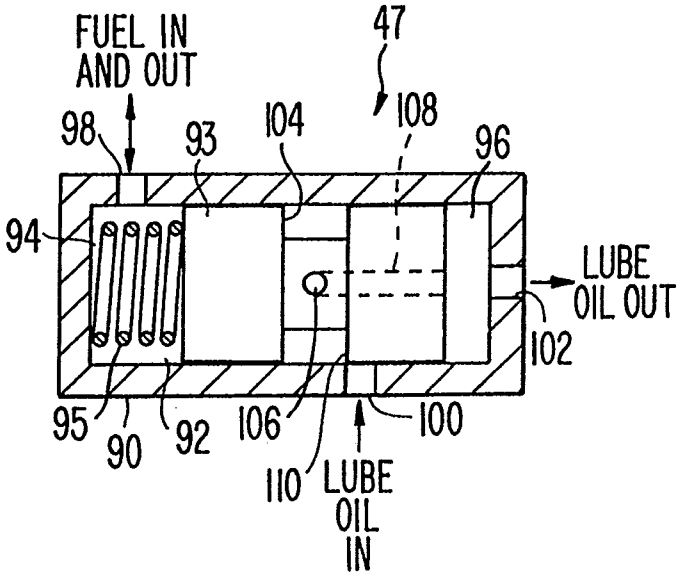
FIG. 3 is a partial cross-sectional view of the lubrication oil supply pressure regulator illustrated in FIG. 1.

Referring to FIG. 3, lubrication oil supply pressure regulator 47 may include a housing 90 having a cylindrical cavity 92. A piston 93 is slidably positioned in cavity 92 to form a fuel chamber 94 on one side of piston 93 and a lube oil chamber 96 on a second side of piston 93 opposite fuel chamber 94. A biasing spring 95 positioned in fuel chamber 94 biases piston 93 toward lube oil chamber 96. Housing 90 includes a fuel port 98 for allowing fuel to flow in and out of fuel chamber 94, a lube oil inlet port 100 and a lube oil outlet port 102 communicating with lube oil chamber 96. An annular groove 104, radial passage 106 and axial passage 108 provide a flow path from inlet port 100 through piston 94 to outlet port 102 depending on the position of piston 93. An edge portion 110 formed on piston 93 by groove 104 is used to regulate the flow and the pressure of lube oil to supply passage 46 of the injector. Throughout the operation of regulator 47, both fuel pressure in fuel chamber 94 and the biasing force of spring 95 acts against piston 93. When the lube oil pressure in chamber 96 becomes less than the sum of the fuel pressure force and the biasing spring force, the piston 93 moves toward lube oil chamber 96 causing edge portion 110 to uncover outlet port 100 allowing lube oil to flow into groove 104, through passages 106 and 108, and into chamber 96. Since the lube oil supplied to inlet port 100 has a pressure greater than the sum of the fuel pressure force and bias spring force, the lube oil pressure forces move the piston 93 back toward the fuel chamber 94 causing edge portion 110 to begin to cover inlet port 100 thereby decreasing the flow of lube oil to chamber 96. As a result, the lube oil pressure in chamber 96 and in the supply passages downstream of regulator 47 will decrease as lube oil is passed through the lubrication fluid supply circuit of the injector. However, as the pressure of the lube oil in chamber 96, and supply passage 46 downstream of outlet port 102, varies, the regulator 47 will constantly maintain the lube oil supply at a pressure above the fuel supply pressure by an amount corresponding to the force needed to overcome bias spring 95. By maintaining the lubrication fluid supply pressure higher than the fuel supply pressure at all times, the lubrication fluid supply can be used to accurately control the amount of fuel metered in metering chamber 56 by bringing the metering plunger 34 to a complete and precise stop during the metering phase of injector operation described in more detail below.

Figure 2C:
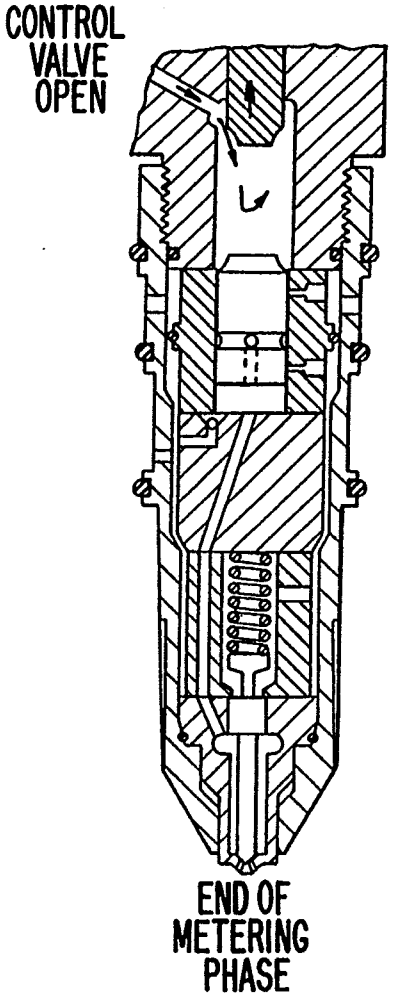
FIG. 2*c* is a cutaway cross-sectional view of the fuel injector illustrated in FIG. 1 as the injector would appear at the end of the metering phase as the timing plunger is moving upwardly.

Operation of the fuel injector is best explained with reference to both FIGS. 1 and 2*a* through 2*e*. As shown in FIGS. 1 and 2*a*, with the cam (not shown) nearing the outer base circle at the end of the injection phase, metering plunger 34 is at its innermost position and timing plunger 36 is nearing its innermost position. At this time, valve element 44 of control valve 4 is closed blocking lubrication timing fluid flow through passage 31. The high pressure fuel in metering chamber 56, passage 74, passage 76, and cavity 80 is relieved back to fuel drain through axial passage 72, radial passage 70, annular groove 68, spill orifice 64 and spill port 66 as represented by the arrows in FIG. 2*a*. Also, pressurized timing fluid in timing chamber 38 spills through timing spill orifice 48, timing spill port 50 and spill channel 52 to the lubrication drain system.

Figure 2B:
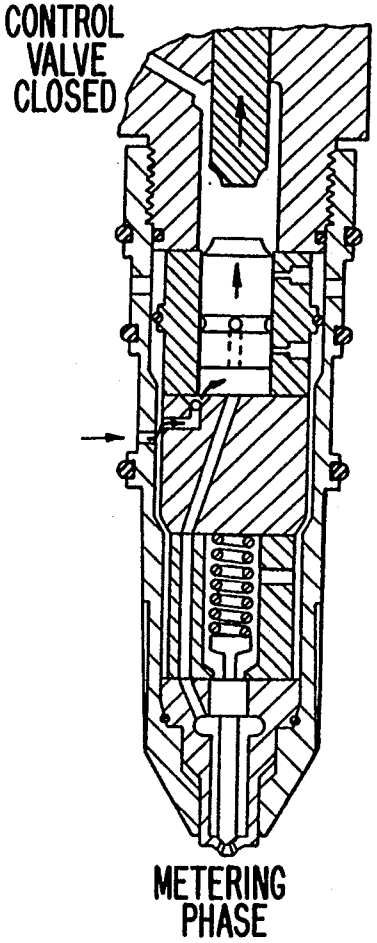
FIG. 2*b* is a cutaway cross-sectional view of the fuel injector illustrated in FIG. 1 during the metering phase.
Figure 2A:
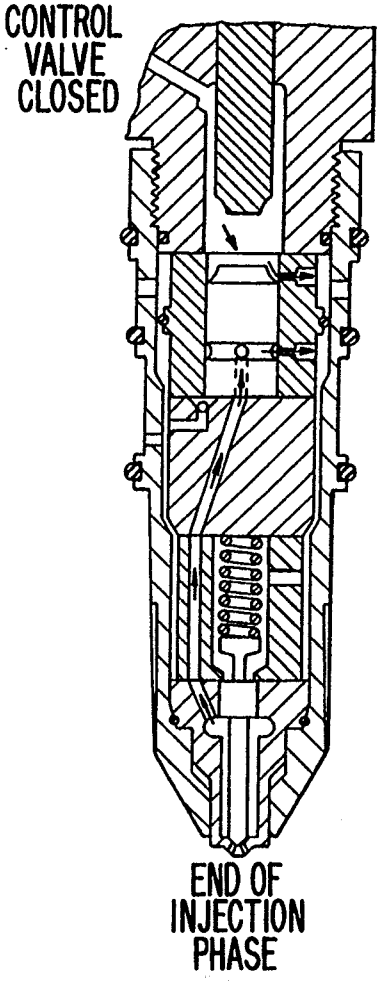
FIG. 2*a* is a cutaway cross-sectional view of the fuel injector illustrated in FIG. 1 at the end of an injection phase.

As shown in FIG. 2*b*, as the cam (not shown) continues to rotate and move toward the inner base circle, coupling 26 is urged outwardly following the cam profile by the biasing force generated by the coupling spring 28 acting outwardly on coupling 26. Although timing plunger 36 is not physically connected to coupling 26, timing plunger 36 is urged outwardly toward coupling 26 by the pressure of the fuel delivered to metering chamber 56 via inlet passage 60 and ball check valve 62. Fuel supply at rail pressure flows into metering chamber 56 and acts against the lower surface of metering plunger 34 to force metering plunger 34 outwardly toward timing plunger 36 thus beginning the metering phase of injector operation. Since control valve 4 is closed, lubrication fluid pressure in timing chamber 38 is substantially reduced when coupling 26 commences its outward movement thereby allowing outward movement of metering plunger 34 caused by the fuel flowing into the metering chamber. As metering plunger 34 moves outwardly, first raised portion 35 of metering plunger 34 covers lubrication timing fluid spill orifice 48, blocking the flow of lube oil from timing chamber 38. Also, second raised portion 37 covers metering spill orifice 64 blocking the flow of fuel out of metering chamber 56. Any lubrication oil left in the timing chamber is trapped. Thus, timing plunger 36 is moved outwardly maintaining contact with coupling 26 while the metering plunger 34 also moves outwardly following timing plunger 36.

As shown in FIG. 2*c*, when the desired quantity of fuel for injection has been metered into metering chamber 56, control valve 4 is operated to open valve element 44, allowing lubrication timing fluid under pressure to flow from supply passage 46 through passage 40 and into timing chamber 38. The pressure of the lubrication timing fluid upstream of control valve 4 is regulated to a pressure higher than the fuel rail pressure so that when control valve 4 is opened, the higher pressure forces acting on the upper face of metering plunger 34 are greater than the fuel pressure forces acting on the lower face of metering plunger 34. As a result, when control valve element 44 is opened, metering plunger 34 is brought to a full and precise stop thereby defining a metered quantity of fuel. Thus, an accurately metered volume of fuel is admitted into the metering chamber 56 and maintained for subsequent injection. The timing of the opening of control valve element 44 with respect to the position of metering plunger 34 is determined by the desired quantity of fuel for injection. If the opening signal to control valve 4 is delayed, a greater quantity of fuel would be metered into metering chamber 56 whereas if the opening signal is advanced, a lesser quantity of fuel would be metered and, likewise, injected during the injection phase. Lube oil timing fluid pressure in timing chamber 38 also induces enough pressure on the fuel in metering chamber 56 via metering plunger 34 to encourage ball check valve 62 to fully seat thereby sealing metering chamber 56.

As shown in FIG. 2*c*, timing plunger 36 continues to move outward following coupling 26 away from the now suspended metering plunger 34 under the force created by the lube oil timing fluid pressure entering timing chamber 38. The volume of timing chamber 38 thus increases as it is filled with lubrication timing fluid. As shown in FIG. 2*d*, as the cam moves toward its outer base circle forcing timing plunger 36 inwardly into timing chamber 38, control valve 4 remains open to allow a preinjection backflow of lubrication fluid out of timing chamber 38 through passage 40, control chamber 42 and supply passage 46 into the lube oil supply system.

Figure 2E:
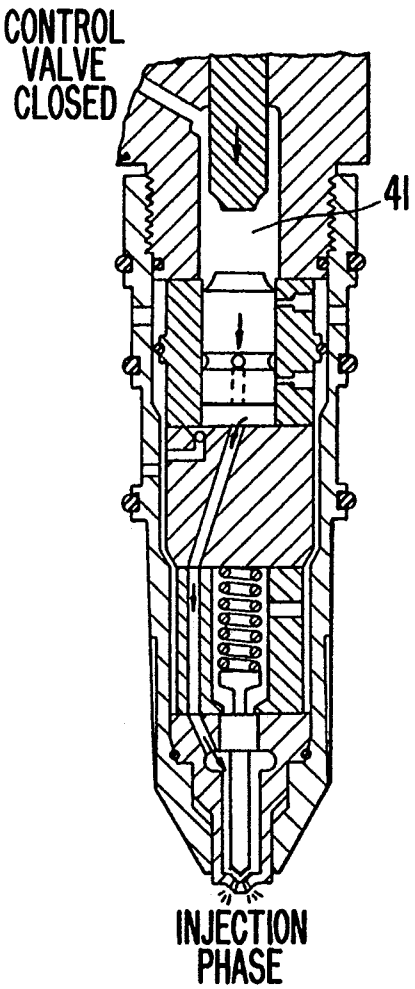
FIG. 2*e* is a cutaway cross-sectional view of the fuel injector illustrated in FIG. 1 during the injection phase.
Figure 2D:
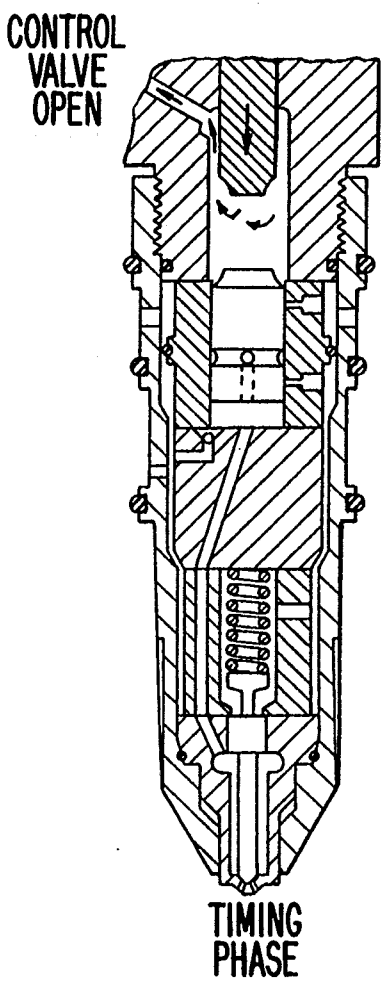
FIG. 2*d* is a cutaway cross-sectional view of the fuel injector illustrated in FIG. 1 during the timing phase as the timing plunger is moving downwardly.

Referring to FIG. 2*e*, a signal is sent to control valve 4 at a selected point during the downstroke of timing plunger 36, depending on operating conditions, causing valve element 44 to close. With the control valve element 44 closed, lubrication fluid is no longer allowed to flow out of the timing chamber 38 through passage 40. Thus, preinjection backflow of the timing fluid is terminated and a lubrication fluid link 41 is formed in timing chamber 38. The length of lubrication fluid link 41 determines the timing of fuel injection relative to the position of the engine piston (not shown). By changing the time at which control valve element 44 is closed, the effective length of lubrication fluid link 41 can be varied thereby varying the timing of fuel injection. Continued movement of timing plunger 36 toward metering plunger 34 causes the pressure in both timing chamber 38 and metering chamber 56 to increase. The increase in fuel pressure in metering chamber 56 causes a corresponding increase in fuel pressure in nozzle cavity 80 since chamber 56 and nozzle cavity 80 are connected by transfer passage 74, passage 76 and passage 78. When the pressure of the fuel in nozzle cavity 80 exceeds a predetermined level corresponding to the bias pressure of spring 86, tip valve element 84 moves outwardly to allow fuel to pass through the injector orifice(s) 82 into the combustion chamber (not shown). During this injection phase, timing plunger 36, lubrication fluid link 41 and metering plunger 34 continue to move inwardly, forcing fuel from metering chamber 56 through passage 74, passage 76 and passage 78 and out injector orifice(s) 82. Injection continues until annular groove 68 of metering plunger 34 communicates with metering spill orifice 64 allowing fuel to flow from metering chamber 56 through axial passage 72, radial passage 70 and annular groove 68 and into metering spill port 66 back to the low pressure fuel supply rail. At approximately the same moment, first raised portion 35 uncovers timing spill orifice 48 allowing lubrication fluid to flow through timing spill port 50 into the lubrication drain system. Thus, as the spill orifices are uncovered, the pressure residual existing in the timing and metering chambers is relieved, stopping the downward movement of metering plunger 34. Timing spill orifice 48 restricts the flow of lubrication fluid spilling from timing chamber 38 to create a hold down force sufficient to keep metering plunger 34 from bouncing outwardly thereby ensuring a sharp end of injection. Once fuel pressure in nozzle cavity 80 is relieved to a predetermined pressure, spring 86 will move tip valve element 84 to a closed position sealing injector orifice(s) 82 and ending injection. At this point, the metering plunger is in its innermost position and the system is ready to begin the next metering phase as shown in FIG. *2a*.

The use of lubrication fluid as a timing fluid in a lubrication timing fluid circuit completely separate from the fuel metering circuit serves several important functions. First, by using lubrication fluid instead of fuel as the timing fluid, the fuel supply demanded by each injector on a cycle by cycle basis is reduced significantly which reduces the amount of hot fuel returned to the fuel supply tank downstream of the fuel drain. As a result, the fuel temperature in the fuel supply tank is reduced significantly minimizing undesired fuel evaporation and avoiding the need for expensive fuel coolers. Secondly, by separating the timing fluid circuit from the fuel metering circuit, any pressure spikes or waves created by the lubrication timing fluid spill event during each cycle are isolated from the fuel supply rail and, therefore, fuel metering simultaneously occurring in other injectors is not adversely affected. The need for starvation orifices and pressure relief valves known in the prior art are also eliminated by the separation of timing fluid circuit from the fuel supply circuit. Thirdly, the lubrication fluid pressure can be controlled in relation to the fuel pressure to bring the metering plunger to a full and precise stop to accurately define the quantity of fuel metered thereby avoiding the need for a bias spring. By eliminating the bias spring, the fixed preload, ordinarily created by the bias spring which must be overcome by fuel pressure to move the metering piston, is also eliminated. Therefore, less fuel pressure is needed at start-up to commence fuel metering. Fourth, the lubrication fluid provides improved lubrication of the timing plunger as it reciprocates in cavity 20. Fifth, a leakoff passage or groove is not needed between timing chamber 38 and upper cavity 22 because the lubrication fluid that escapes from the outer end of the injector body through the annular clearance gap between the timing plunger and the injector cavity, is simply released into the rocker housing of the engine where engine lubrication oil already exists. Therefore, any leak-by lubrication fluid can likewise be used to lubricate coupling 26 and any other linkage in the rocker housing. Sixth, the lubrication fluid functions to cool the fuel injector internals as it flows through the lubrication fluid timing circuit during each cycle.

INDUSTRIAL APPLICABILITY

The lubrication oil controlled unit injector heretofore described may be used in compression injection and spark injection engines of any vehicle or industrial equipment where accurate and reliable control and variation of both the timing of injection and the metering of the quantity of fuel for injection is essential.

We claim:

1. A fuel injector for periodic injection of fuel into a combustion chamber of an engine at variable times from cycle to cycle under the control of the engine lubrication fluid, comprising:

an injector body containing an injector cavity and a discharge orifice communicating with one end of said injector cavity to discharge fuel into the combustion chamber, said injector body including a lubrication fluid tinting circuit and a fuel metering circuit separate from said lubrication fluid timing circuit; and a variable hydraulic timing and metering means for varying the timing and metering of fuel injection by the fuel injector on a cycle by cycle basis by controlling the flow of lubrication fluid in said lubrication fluid timing circuit to form a lubrication fluid link having a variable effective length positioned in said lubrication fluid timing circuit within said injector cavity, said variable hydraulic timing and metering means including a control valve positioned within said lubrication fluid timing circuit for controlling the flow of lubrication fluid in said lubrication fluid timing circuit to vary said variable effective length of said lubrication fluid link to vary the timing of fuel injection, said control valve operable to vary the metering of fuel for fuel injection by the fuel injector on a cycle by cycle basis, wherein said control valve is movable from a first position in which lubrication fluid may flow through said lubrication fluid timing circuit and a second position in which lubrication fluid flow through said lubrication fluid timing circuit to said lubrication fluid link is blocked to define a specific effective length of said lubrication fluid link corresponding to a specific timing for beginning fuel injection.

2. The fuel injector of claim 1, further including a timing plunger and a metering plunger reciprocally mounted in said injector cavity, a timing chamber formed in said injector cavity between said timing plunger and said metering plunger for receiving said lubrication fluid link and a metering chamber formed in said injector cavity between said metering plunger and said discharge orifice.

3. The fuel injector of claim 2, wherein said control valve is an electromagnetic valve operable to be placed in said first position in which lubrication fluid may flow through said lubrication fluid timing circuit into said timing chamber to vary said variable effective length of said lubrication fluid link and fuel flow from said fuel metering circuit into said metering chamber is stopped, and said second position in which lubrication fluid flow into said timing chamber is shut off to define said specific effective length of said lubrication fluid link.

4. The fuel injector of claim 3, wherein movement of said electromagnetic valve into said first position stops movement of said metering plunger in said injector cavity.

5. The fuel injector of claim 3, wherein the lubrication fluid in said timing chamber is maintained at a lubrication fluid pressure greater than the fuel pressure in said metering chamber when said electromagnetic valve is in said first position.

6. The fuel injector of claim 2, further including a lubrication fluid timing spill valve means for permitting the flow of lubrication fluid from said injector cavity for return to said lubrication fluid timing circuit, said timing spill valve means including a lubrication fluid spill port formed in said injector body and communicating with said timing chamber.

7. The fuel injector of claim 6, wherein said timing spill valve means includes a first raised section formed on said metering plunger adjacent said lubrication fluid spill port and movable into a blocking position in which lubrication fluid flow through said lubrication fluid spill port is shut off and a spill position which permits lubrication fluid flow through said lubrication fluid spill port.

8. The fuel injector of claim 7, further including a metering spill valve means for controlling the flow of fuel out of said metering chamber, said metering spill valve means including a metering spill port formed in said injector body and communicating with said metering chamber.

9. The fuel injector of claim 8, wherein said metering spill valve means includes a second raised section formed on said metering plunger and movable into a blocking position in which fuel flow to said metering spill port is shut off and a spill position which permits fuel flow through said metering spill port.

10. The fuel injector of claim 9, wherein said first raised section of said metering plunger and said second raised section of said metering plunger are positioned in the respective said blocking positions when said electromagnetic valve is in said first position.

11. The fuel injector of claim 2, further including a linking means for transmitting a driving force to said timing plunger, said linking means engaging one end of said timing plunger, and an annular clearance gap formed between said timing plunger and said injector cavity for permitting lubrication fluid to flow from said timing chamber through said clearance gap to said linking means to lubricate said linking means.

12. A fuel injector for periodic injection of fuel into a combustion chamber of an engine at variable times and in variable amounts from cycle to cycle under the control of the engine lubrication fluid, comprising:

an injector body containing an injector cavity and an injector orifice communicating with one end of said injector cavity, said injector body including a lubrication fluid timing circuit and a fuel metering circuit fluidically separate from said lubrication fluid timing circuit;

plunger means mounted for reciprocal movement within said injector cavity, said plunger means including a timing plunger and a metering plunger;

a timing chamber formed in said injector cavity between said timing plunger and said metering plunger, said timing chamber communicating with said lubrication fluid timing circuit;

a metering chamber formed in said injector cavity between said metering plunger and said injector orifice;

an electromagnetic valve means for controlling the timing and metering of fuel injection by the fuel injector on a cycle by cycle basis by controlling the flow of lubrication fluid in said lubrication fluid timing circuit, said electromagnetic valve means positioned within said lubrication fluid timing circuit for controlling the flow of lubrication fluid through said lubrication fluid timing circuit, wherein said electromagnetic valve means is operable to be placed in a first position in which lubrication fluid may flow through said lubrication fluid timing circuit into said timing chamber and fuel flow from said fuel metering circuit into said metering chamber is shut off, and a second position in which lubrication fluid flow into said timing chamber is shut off, wherein movement of said electromagnetic valve means into said first position stops movement of said metering plunger in said injector cavity.

13. The fuel injector of claim 12, wherein the lubrication fluid in said timing chamber is maintained at a lubrication fluid pressure greater than the fuel pressure in said metering chamber when said electromagnetic valve means is in said first position.

14. The fuel injector of claim 12, further including a lubrication fluid timing spill valve means for permitting the flow of lubrication fluid from said injector cavity for return to said lubrication fluid timing circuit, said timing spill valve means including a lubrication fluid spill port formed in said injector body and communicating with said timing chamber.

15. The fuel injector of claim 14, wherein said timing spill valve means includes a first raised section formed on said metering plunger adjacent said lubrication fluid spill port and movable into a blocking position in which timing fluid flow through said lubrication fluid spill port is shut off and a spill position which permits timing fluid flow through said lubrication fluid spill port.

16. The fuel injector of claim 15, further including a metering spill valve means for controlling the flow of fuel out of said metering chamber, said metering spill valve means including a metering spill port formed in said injector body and communicating with said metering chamber.

17. The fuel injector of claim 16, wherein said metering spill valve means includes a second raised section formed on said metering plunger and movable into a blocking position in which fuel flow to said metering spill port is shut off and a spill position which permits fuel flow through said metering spill port.

18. The fuel injector of claim 17, wherein said first raised section of said metering plunger and said second raised section of said metering plunger are positioned in the respective said blocking positions when said electromagnetic valve means is in said first position.

19. The fuel injector of claim 12, further including a linking means for transmitting a driving force to said timing plunger, said linking means engaging one end of said timing plunger, and an annular clearance gap formed between said timing plunger and said injector cavity for permitting lubrication fluid to flow from said timing chamber through said clearance gap to said linking means to lubricate and cool said linking means.

20. A fuel injector for periodic injection of fuel into a combustion chamber of an engine, comprising:

an injector body containing an injector cavity and a discharge orifice communicating with one end of said injector cavity to discharge fuel into the combustion chamber;

a timing chamber formed in said injector cavity for receiving timing fluid;

a tinting fluid supply circuit formed in said injector body for delivering timing fluid to said tinting chamber;

a metering chamber formed in said injector cavity between said timing chamber and said discharge orifice for receiving metering fuel;

a metering fuel supply circuit formed in said injector body for delivering metering fuel to said metering chamber;

a control valve means for controlling the flow of timing fluid in said timing fluid supply circuit, wherein the timing fluid in said timing fluid supply circuit upstream of said control valve is constantly maintained at a pressure greater than the pressure of the metering fuel in said metering fuel supply circuit, wherein said timing fluid supply circuit is separate from said metering fuel supply circuit, said control valve means operable to vary the amount of fuel into said metering chamber for subsequent fuel injection by the fuel injector on a cycle by cycle basis.

21. The fuel injector of claim 20, further including a plunger means mounted for reciprocal movement within said injector cavity, said plunger means including a timing plunger and a metering plunger, said metering plunger positioned in said injector cavity between said timing plunger and said injector orifice, said metering chamber formed in said injector cavity between said metering plunger and said injector orifice, and said timing chamber formed in said injector cavity between said timing plunger and said metering plunger, wherein said control valve means is operable to control the flow of timing fluid in said timing fluid supply circuit to form a timing fluid link having a variable effective length in said timing chamber.

22. The fuel injector of claim 21, wherein said control valve means is an electromagnetic valve operable to be placed in a first position in which timing fluid may flow through said timing fluid circuit into said timing chamber to vary said variable effective length of said timing fluid link and fuel flow from said fuel metering circuit into said metering chamber is stopped, and a second position in which timing fluid flow into said timing chamber is shut off to define a specific effective length of said timing fluid link.

23. The fuel injector of claim 22, wherein movement of said electromagnetic valve into said first position stops movement of said metering plunger in said injector cavity.

24. The fuel injector of claim 22, wherein the timing fluid in said timing chamber is maintained at a fluid pressure greater than the fuel pressure in said metering chamber when said electromagnetic valve is in said first position.

25. The fuel injector of claim 20, further including a timing fluid spill valve means for permitting the flow of timing fluid from said injector cavity for return to said timing fluid supply circuit, said timing fluid spill valve means including a timing fluid spill port formed in said injector body and communicating with said timing chamber and a first raised section formed on said metering plunger adjacent said timing fluid spill port and movable into a blocking position in which timing fluid flow through said timing fluid spill port is shut off and a spill position which permits timing fluid flow through said timing fluid spill port.

26. The fuel injector of claim 25, further including a metering spill valve means for controlling the flow of fuel out of said metering chamber, said metering spill valve means including a metering spill port formed in said injector body and communicating with said metering chamber, and a second raised section formed on said metering plunger and movable into a blocking position in which fuel flow to said metering spill port is shut off and a spill position which permits fuel flow through said metering spill port.

27. A fuel injector for periodic injection of fuel into a combustion chamber of an engine at variable times from cycle to cycle under the control of the engine lubrication fluid, comprising:

an injector body containing an injector cavity and a discharge orifice communicating with one end of said injector cavity to discharge fuel into the combustion chamber, said injector body including a lubrication fluid timing circuit and a fuel metering circuit separate from said lubrication fluid timing circuit; and a variable hydraulic timing and metering means for varying the timing and metering of fuel injection by the fuel injector on a cycle by cycle basis by controlling the flow of lubrication fluid in said lubrication fluid timing circuit to form a lubrication fluid link having a variable effective length positioned in said lubrication fluid timing circuit within said injector cavity, said variable hydraulic timing and metering means including a control valve positioned within said lubrication fluid timing circuit for controlling the flow of lubrication fluid in said lubrication fluid timing circuit to vary said variable effective length of said lubrication fluid link to vary the timing of fuel injection, said control valve operable to vary the metering of fuel for fuel injection by the fuel injector on a cycle by cycle basis, further including a timing plunger and a metering plunger reciprocally mounted in said injector cavity, a timing chamber formed in said injector cavity between said timing plunger and said metering plunger for receiving said lubrication fluid link and a metering chamber formed in said injector cavity between said metering plunger and said discharge orifice, said control valve including an electromagnetic valve operable to be placed in a first position in which lubrication fluid may flow through said lubrication fluid timing circuit into said timing chamber to vary said variable effective length of said lubrication fluid link and fuel flow from said fuel metering circuit into said metering chamber is stopped, and a second position in which lubrication fluid flow into said timing chamber is shut off to define a specific effective length of said lubrication fluid link, wherein movement of said electromagnetic valve into said first position stops movement of said metering plunger in said injector cavity.

28. A fuel injector for periodic injection of fuel into a combustion chamber of an engine at variable times from cycle to cycle under the control of the engine lubrication fluid, comprising:

an injector body containing an injector cavity and a discharge orifice communicating with one end of said injector cavity to discharge fuel into the combustion chamber, said injector body including a lubrication fluid timing circuit and a fuel metering circuit separate from said lubrication fluid timing circuit; and a variable hydraulic timing and metering means for varying the timing and metering of fuel injection by the fuel injector on a cycle by cycle basis by controlling the flow of lubrication fluid in said lubrication fluid timing circuit to form a lubrication fluid link having a variable effective length positioned in said lubrication fluid timing circuit within said injector cavity, said variable hydraulic timing and metering means including a control valve positioned within said lubrication fluid timing circuit for controlling the flow of lubrication fluid in said lubrication fluid timing circuit to vary said variable effective length of said lubrication fluid link to vary the timing of fuel injection, said control valve operable to vary the metering of fuel for fuel injection by the fuel injector on a cycle by cycle basis, further including a timing plunger and a metering plunger reciprocally mounted in said injector cavity, a timing chamber formed in said injector cavity between said timing plunger and said metering plunger for receiving said lubrication fluid link, a metering chamber formed in said injector cavity between said metering plunger and said discharge orifice, a linking means for transmitting a driving force to said timing plunger, said linking means engaging one end of said timing plunger, and an annular clearance gap formed between said timing plunger and said injector cavity for permitting lubrication fluid to flow from said timing chamber through said clearance gap to said linking means to lubricate said linking means.

29. A fuel injector for periodic injection of fuel into a combustion chamber of an engine at variable times and in variable amounts from cycle to cycle under the control of the engine lubrication fluid, comprising:

an injector body containing an injector cavity and an injector orifice communicating with one end of said injector cavity, said injector body including a lubrication fluid timing circuit and a fuel metering circuit fluidically separate from said lubrication fluid timing circuit;

plunger means mounted for reciprocal movement within said injector cavity, said plunger means including a timing plunger and a metering plunger;

a timing chamber formed in said injector cavity between said timing plunger and said metering plunger, said timing chamber communicating with said lubrication fluid timing circuit;

a metering chamber formed in said injector cavity between said metering plunger and said injector orifice;

a linking means for transmitting a driving force to said timing plunger, said linking means engaging one end of said timing plunger, and an annular clearance gap formed between said timing plunger and said injector cavity for permitting lubrication fluid to flow from said timing chamber through said clearance gap to said linking means to lubricate and cool said linking means; and an electromagnetic valve means for controlling the timing and metering of fuel injection by the fuel injector on a cycle by cycle basis by controlling the flow of lubrication fluid in said lubrication fluid timing circuit, said electromagnetic valve means positioned within said lubrication fluid timing circuit for controlling the flow of lubrication fluid through said lubrication fluid timing circuit, wherein said electromagnetic valve means is operable to be placed in a first position in which lubrication fluid may flow through said lubrication fluid timing circuit into said timing chamber and fuel flow from said fuel metering circuit into said metering chamber is shut off, and a second position in which lubrication fluid flow into said timing chamber is shut off.

30. A fuel injector for periodic injection of fuel into a combustion chamber of an engine, comprising:

an injector body containing an injector cavity and a discharge orifice communicating with one end of said injector cavity to discharge fuel into the combustion chamber;

a timing chamber formed in said injector cavity for receiving timing fluid;

a timing fluid supply circuit formed in said injector body for delivering timing fluid to said timing chamber;

a metering chamber formed in said injector cavity between said timing chamber and said discharge orifice for receiving metering fuel;

a metering fuel supply circuit formed in said injector body for delivering metering fuel to said metering chamber;

a control valve means for controlling the flow of timing fluid in said timing fluid supply circuit, wherein the timing fluid in said timing fluid supply circuit upstream of said control valve is constantly maintained at a pressure greater than the pressure of the metering fuel in said metering fuel supply circuit; and a timing fluid spill valve means for permitting the flow of timing fluid from said injector cavity for return to said timing fluid supply circuit, said timing fluid spill valve means including a timing fluid spill port formed in said injector body and communicating with said timing chamber and a first raised section formed on said metering plunger adjacent said timing fluid spill port and movable into a blocking position in which timing fluid flow through said timing fluid spill port is shut off and a spill position which permits timing fluid flow through said timing fluid spill port.

31. A fuel injector for periodic injection of fuel into a combustion chamber of an engine at variable times from cycle to cycle under the control of the engine lubrication fluid, comprising:

an injector body containing an injector cavity and a discharge orifice communicating with one end of said injector cavity to discharge fuel into the combustion chamber, said injector body including a lubrication fluid timing circuit and a fuel metering circuit separate from said lubrication fluid timing circuit;

a variable hydraulic timing and metering means for varying the timing and metering of fuel injection by the fuel injector on a cycle by cycle basis by controlling the flow of lubrication fluid in said lubrication fluid timing circuit to form a lubrication fluid link having a variable effective length positioned in said lubrication fluid timing circuit within said injector cavity, said variable hydraulic timing and metering means including a control valve positioned within said lubrication fluid timing circuit for controlling the flow of lubrication fluid in said lubrication fluid timing circuit to vary said variable effective length of said lubrication fluid link to vary the timing of fuel injection, said control valve operable to vary the metering of fuel for fuel injection by the fuel injector on a cycle by cycle basis; and a timing plunger and a metering plunger reciprocally mounted in said injector cavity, a tinting chamber formed in said injector cavity between said timing plunger and said metering plunger for receiving said lubrication fluid link and a metering chamber formed in said injector cavity between said metering plunger and said discharge orifice, wherein said lubrication fluid timing circuit is separate from said fuel metering circuit, said control valve operable to vary the amount of fuel into said metering chamber for subsequent fuel injection by the fuel injector on a cycle by cycle basis.

* * * * *